US008357856B2

(12) United States Patent
Grögl et al.

(10) Patent No.: US 8,357,856 B2
(45) Date of Patent: Jan. 22, 2013

(54) ELECTRIC CABLE

(75) Inventors: Ferdinand Grögl, Nürnberg (DE); Angela Brutler, Hilpoltstein (DE)

(73) Assignee: Nexans, Paris (FR)

( * ) Notice: Subject to any disclaimer, the term of this patent is extended or adjusted under 35 U.S.C. 154(b) by 325 days.

(21) Appl. No.: 12/666,172

(22) PCT Filed: May 21, 2008

(86) PCT No.: PCT/EP2008/004050

§ 371 (c)(1),
(2), (4) Date: Jul. 1, 2010

(87) PCT Pub. No.: WO2008/141807

PCT Pub. Date: Nov. 27, 2008

(65) Prior Publication Data

US 2010/0263909 A1 Oct. 21, 2010

(30) Foreign Application Priority Data

May 21, 2007 (EP) ..... 07290651

(51) Int. Cl.
*H01B 5/00* (2006.01)

(52) U.S. Cl. ..... 174/126.2

(58) Field of Classification Search ..... 174/126.2, 174/106 R, 126.1

See application file for complete search history.

(56) References Cited

U.S. PATENT DOCUMENTS 2,918,722 A * 12/1959 Kenmore ..... 428/658
5,969,229 A * 10/1999 Hori et al. ..... 73/23.31
6,658,836 B2 * 12/2003 Nguyen et al. ..... 57/218
2004/0231883 A1 11/2004 Kondu et al.

FOREIGN PATENT DOCUMENTS

DE 19744667 4/1998

OTHER PUBLICATIONS

PCT Notification of Transmittal of translation of the International Preliminary Report on Patentability dated Dec. 17, 2009.
International Search Report dated Jan. 10, 2008.

* cited by examiner

*Primary Examiner* — Chau Nguyen
(74) *Attorney, Agent, or Firm* — Sofer & Haroun, LLP

(57) ABSTRACT

The invention relates to an electric conductor (L), made of an electrically conductive material comprising aluminum. The electric conductor is surrounded at least in a region intended for the connection of an electric contact element by a protective layer (3) serving the corrosion protection. The conductive material (2) is formed around a steel wire (1) having a diameter between 0.05 mm and 0.2 mm and a fracture strength of at least 1000 N/mm$^2$ and having such a wall thickness that a conductor (L) having a diameter between 0.10 mm and 0.40 mm is obtained, onto which the protective layer (3) is applied having a thickness of at least 0.5 μm.

3 Claims, 1 Drawing Sheet

ELECTRIC CABLE

RELATED APPLICATIONS

This application is a National Phase Application of PCT/EP2008/141807 filed on May 21, 2008 with in turn claims the benefit of priority from EP 07290651.4 filed on May 21, 2007, the entirety of which is incorporated herein by reference

BACKGROUND

1. Field of the Invention

The invention relates to an electrical conductor which is composed of an electrically conductive material containing aluminum, and is surrounded all round at least in an area intended for a connection of an electrical contact element by a protective layer which is used for corrosion protection (DE 22 50 836 A).

2. Description of Related Art

Electrical conductors composed of aluminum or an aluminum alloy are being increasingly used as a replacement for copper conductors, in particular for weight and cost reasons. The main fields of use are, for example, automobile technology and aircraft technology. The lower electrical conductivity of the aluminum in comparison to copper is of secondary importance for most applications. In order as far as possible to preclude oxidation of the surface of a conductor such as this, it is embedded in a protective layer, after appropriate pretreatment. A protective layer such as this, composed of a zinc-tin alloy, is applied, for example according to the initially cited DE 22 50 836 A, by ultrasound coating to the end of a previously solidified, multicore conductor composed of aluminum. The aim in this case is for the oxidation layer on the conductor to be rubbed off it by vibration.

In the following text, the word "conductor" represents conductors composed of aluminum and conductors composed of an aluminum alloy. Both materials are also referred to in the following text as "conductive material". Conductors such as these are known as solid conductors or as braided conductors. They are of such a size that, on the one hand, an adequate cross section of conductive material is available for current transmission and, on the other hand, adequate mechanical strength of the conductor is ensured, in particular with respect to tensile loads. The relatively large amount of material use that this results in is partially compensated for by the weight advantage in comparison to a conductor composed of copper.

OBJECTS AND SUMMARY

The invention is based on the object of developing the conductor described initially such that it is possible to reduce the amount of conductive material used.

According to the invention, this object is achieved in that the conductive material is shaped around a steel wire having a diameter of between 0.05 mm and 0.2 mm and an ultimate strength of at least 1000 N/mm$^2$ with a wall thickness such that a conductor with a diameter between 0.10 mm and 0.40 mm results, onto which the protective layer is applied, with a thickness of at least 0.5 μm.

The steel wire gives this conductor considerably greater tensile strength, as a result of which less conductive material is required for its mechanical robustness. Its material thickness in the layer surrounding the steel wire can be limited in this way in particular to a cross section which is sufficient for the transmission of control currents at a low current level, and of data and/or control signals. The conductor itself as well as a line which is formed by a conductor such as this can therefore overall be produced to be smaller, lighter and cheaper. The continuously applied, very thin protective layer protects the conductor against corrosion, as a result of which, if required, a contact element can be electrically conductively fitted to any point on the conductor, without pretreatment thereof. This results in the further advantage that the known effect of the conductive material flowing away in the area of a contact point does not occur, because of the reduced amount of conductive material and because of the central steel wire.

BRIEF DESCRIPTION OF THE DRAWINGS

One exemplary embodiment of the subject matter according to the invention is illustrated in the drawings, in which.

DETAILED DESCRIPTION

Figure 1:
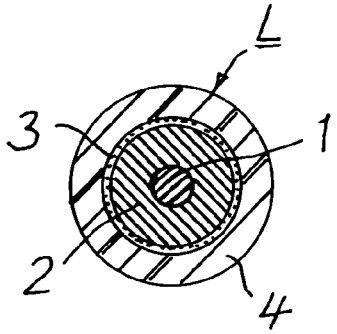
FIG. 1 shows a cross section through a conductor according to the invention.

In its core, the conductor L as shown in FIG. 1 has a steel wire 1 around which a layer 2 composed of aluminum or an aluminum alloy—also referred to in the following text as "conductive material"—is fitted. A thin protective layer 3, which is closed all round and may be composed, for example, of tin, nickel or silver, is placed over the layer 2. Tin or nickel is preferably used when the conductor L is intended to be used in areas with high temperatures. Silver is advantageous for use in the radio-frequency range. The conductor L is surrounded by an insulating sleeve 4 when it is intended to be used as an individual conductor. This is advantageously composed of a temperature-resistant material. Suitable materials for the insulating sleeve 4 are, for example, polyvinyl chloride, polypropylene, thermoplastic elastomers such as polyurethane and polyester, self-crosslinking or beam-crosslinkable polymers, such as cross-linked polyethylene, elastomers such as EVA, and fluoropolymers, such as ethylene tetrafluoroethylene, fluoro-ethylene propylene, polytetrafluoroethylene or perfluoroalkoxy copolymer as well as silicone.

Figure 2:
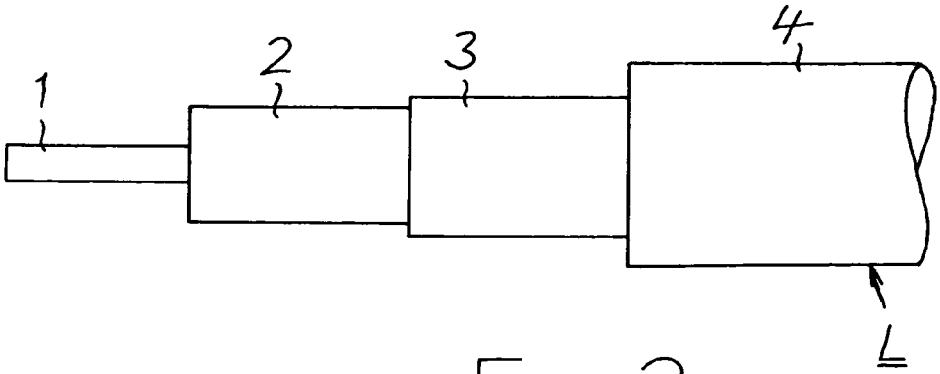
FIG. 2 shows a side view of the conductor with layers removed in places.
Figure 3:
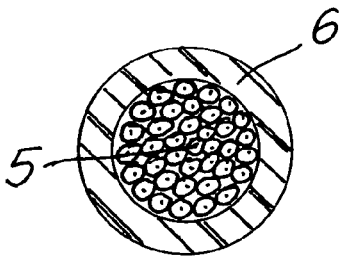
FIG. 3 shows a braided conductor having a plurality of conductors as shown in FIG. 1.

By way of example, the conductor L as shown in FIGS. 1 and 2 is produced as follows:

The raw materials are a soft steel wire with a diameter of, for example, 4.0 mm, an ultimate strength of at least 3.50 N/mm$^2$, a modulus of elasticity of at least 210 kN/mm$^2$ and an electrical conductivity of at least 5 m/ohm×mm$^2$, as well as pure aluminum or an aluminum alloy as the conductive material, having an ultimate strength of at least 10 N/mm$^2$, a modulus of elasticity of at least 60 kN/mm$^2$, preferably 65 kN/mm$^2$, and an electrical conductivity of 35 m/ohm×mm$^2$. The production of the conductor L is based on a standard ratio of the moduli of elasticity of steel and aluminum of 3.2, corresponding to the stated values (210:65). Material optimization processes can also lead to slightly different moduli of elasticity and therefore also take a slightly different ratio of the moduli of elasticity.

The abovementioned raw materials are used to produce a strand by pressing the layer 2 composed of the conductive material with a wall thickness of 2.1 mm around the steel wire 1, for example by means of a stamping press. The strand then has a diameter of 8.2 mm. The material amounts of steel and conductive material that are used correspond, in relation to one another, to the abovementioned ratio of 3.2 of the moduli of elasticity of the two materials. The diameter of the steel wire may differ slightly if the ratio between the moduli of elasticity of steel and conductive material is different.

During the process of manufacturing the strand, its surface oxidizes if this is not prevented by special measures. The oxide layer formed in this case is a weather-resistant protective layer for the strand when it is stored before further processing.

In a later or directly subsequent manufacturing step, the oxide layer can first of all be removed from the strand, for example by chemical means. The strand is then subjected to a rough drawing process, preferably already in an inert gas atmosphere, to an initial drawn wire size in the range from 1.2 mm to 2.0 mm, preferably 1.8 mm. At the end of the drawing process, during which the surface of the strand has not yet formed a new oxide layer, the protective layer 3 is applied to the strand while (still) in the inert gas atmosphere, for example by electrochemical deposition or hot-tinning. A protective layer 3 composed of tin has a thickness of at least 6 μm. The steel wire 1 in an initially drawn wire with a diameter of 1.8 mm has a diameter of about 0.875 mm.

The initially drawn wire with a protective layer 3 can be drawn down to the required final dimensions of the conductor L by means of multiple drawing machines. After the drawing process, the protective layer 3 has a thickness in the range from 0.5 μm to 1.0 μm for this final size of the conductor L. When other materials, such as nickel or silver, are used, which are required for high-temperature or radio-frequency products, greater layer thicknesses may also result for the protective layer 3, depending on the requirement for the conductor L.

Conductors L produced using the described method may, for example, have the diameters shown in the following table 1. In all the embodiments, they have a relative density of, for example, 3.9 g/cm$^3$ and an electrical conductivity of, for example, >27 m/ohm×mm$^2$. The steel wire has an ultimate strength of about 1000 N/mm$^2$.

TABLE 1

| Steel wire diameter [mm] | Conductor diameter [mm] |
|---|---|
| 0.05 | 0.102 |
| 0.073 | 0.150 |
| 0.089 | 0.183 |
| 0.109 | 0.225 |
| 0.125 | 0.258 |
| 0.199 | 0.317 |
| 0.199 | 0.409 |

When a conductor L as shown in FIGS. 1 and 2 is used as a single conductor, a braided conductor 5 can advantageously be produced in which a number of single conductors are twisted with one another. An insulating sleeve 6, whose material is advantageously temperature-resistant, is fitted over the braided conductor 5. Suitable materials for the insulating sleeve 6 are, for example, polyvinyl chloride, polypropylene, thermoplastic elastomers such as polyurethane or polyester, self-cross linking or beam-crosslinkable polymers, such as cross-linked polyethylene, elastomers such as EPDM or EVA, and fluoropolymers, such as ethylene tetrafluoroethylene, fluoro ethylene propylene, polytetrafluoroethylene or perfluoroalkoxy copolymer as well as silicone.

A braided conductor 5 which is formed using 19 conductors according to above table 1 has the cross sections and breaking loads shown in the following table 2, which correspond approximately to those of braided conductors with copper conductors of the same cross section.

TABLE 2

| Conductor diameter [mm] | Conductor cross section [mm$^2$] | Ultimate strength [N] |
|---|---|---|
| 0.102 | 0.16 | 40 |
| 0.15 | 0.34 | 75 |
| 0.183 | 0.5 | 115 |
| 0.225 | 0.75 | 170 |
| 0.258 | 1.0 | 230 |
| 0.317 | 1.5 | 340 |
| 0.409 | 2.5 | 570 |

The invention claimed is:

1. Electrical conductor, comprising:

a steel wire having a diameter substantially between 0.05 mm and 0.2 mm and a strength of at least 1000 N/mm$^2$;

an electrically conductive material containing aluminum around said steel wire, with a wall thickness such that a conductor with a diameter substantially between 0.10 mm and 0.40 mm results; and a protective layer, used for corrosion protection, surrounding said electrically conductive material, at least in an area intended for a connection of an electrical contact element, said protective layer having a thickness of at least 0.5 μm.

2. Conductor according to claim 1, wherein the protective layer is composed of tin, nickel or silver.

3. Method for production of a conductor according to claim 1, wherein an electrically highly conductive material containing aluminum is shaped around a steel wire in order to form a strand, onto which material a protective layer is applied all round, and in that the strand is then reduced to the nominal size of the conductor in at least one drawing process.

* * * * *